US006133779A

United States Patent [19]

Sichert et al.

[11] Patent Number: 6,133,779

[45] Date of Patent: Oct. 17, 2000

[54] INTEGRATED CIRCUIT WITH A VOLTAGE REGULATOR

[75] Inventors: Christian Sichert, München; Rainer Bartenschlager, Kaufbeuren, both of Germany

[73] Assignee: Siemens Aktiengesellschaft, Munich, Germany

[21] Appl. No.: 09/356,811

[22] Filed: Jul. 19, 1999

[30] Foreign Application Priority Data

Jul. 17, 1998 [DE] Germany ..... 198 32 309

[51] Int. Cl.[7] ..... G05F 3/02

[52] U.S. Cl. ..... 327/540; 327/541

[58] Field of Search ..... 327/538, 540, 327/541, 543, 544

[56] References Cited

U.S. PATENT DOCUMENTS 5,856,756 1/1999 Sasahara et al. ..... 327/540

6,066,979 5/2000 Adams et al. ..... 327/540

*Primary Examiner*—Jung Ho Kim

*Attorney, Agent, or Firm*—Herbert L. Lerner; Laurence A. Greenberg; Werner H. Stemer

[57] ABSTRACT

An integrated circuit includes a voltage regulator for generating an internal supply voltage. The voltage regulator has one input for applying an actual value and one input for applying a reference voltage as a desired value. The actual value is generated through the use of a first voltage divider from the internal supply voltage. A sensitivity of the voltage regulator is dependent on a resistance of at least one resistor element of the first voltage divider. A second voltage divider, which is connected parallel to the first voltage divider, has the same voltage divider ratio as the first voltage divider and is activatable and deactivatable by at least one switch element.

4 Claims, 1 Drawing Sheet

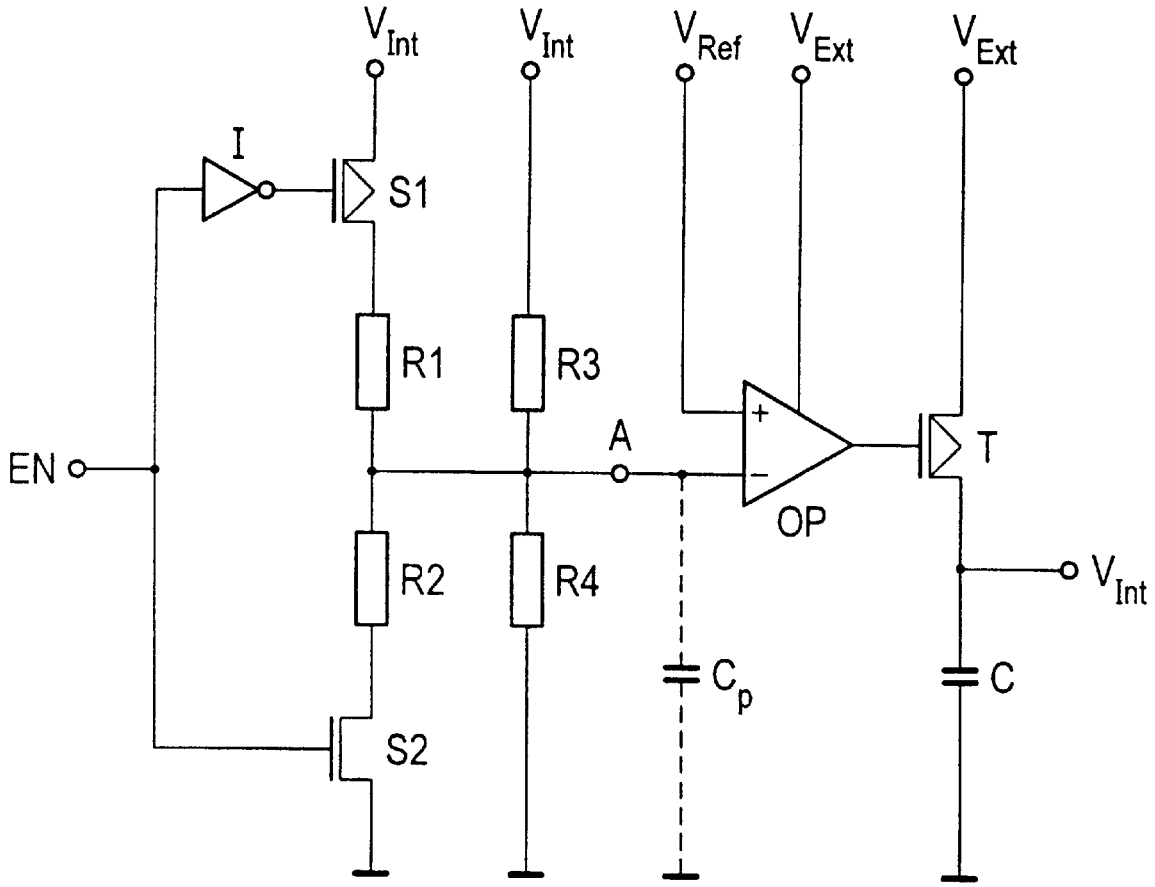
V Int
V Int
V Ref
V Ext
V Ext
I
S1
R1
R3
EN
A
T
OP
R2
R4
V Int
C p
C
S2

INTEGRATED CIRCUIT WITH A VOLTAGE REGULATOR

BACKGROUND OF THE INVENTION

FIELD OF THE INVENTION

The invention relates to an integrated circuit including a voltage regulator for generating an internal supply voltage, the voltage regulator has one input for applying an actual value and one input for applying a reference voltage as a desired value, the actual value is generated from the internal supply voltage by a voltage divider, and a sensitivity of the voltage regulator is dependent on a resistance of at least one resistor element of the voltage divider.

A voltage regulator of that type is described in a book entitled: Halbleiterschaltungstechnik [Semiconductor Circuitry], 10th edition, Berlin 1993, Chapter 18.3.3, by U. Tietze and Ch. Schenk. An operational amplifier is employed as the voltage regulator to which the actual and desired values are applied. The operational amplifier is followed by a switching transistor that furnishes the voltage which is to be regulated and is derived from a higher voltage, at the output of the regulator. A voltage divider ratio of the voltage divider and the value of the reference voltage determine the value of the regulated output voltage. A leakage current, which flows through the voltage divider disposed between the regulated output voltage and ground, becomes greater as the total resistance of the voltage divider becomes lower. However, if the ohmic resistance of the resistor elements of the voltage divider is increased, then the sensitivity of the voltage regulator is reduced. That sensitivity in fact depends on an RC constant, which is determined by the voltage divider and an associated input capacitance of the operational amplifier.

SUMMARY OF THE INVENTION

It is accordingly an object of the invention to provide an integrated circuit with a voltage regulator, which overcomes the hereinafore-mentioned disadvantages of the heretofore-known devices of this general type, in which on one hand adequate sensitivity of the voltage regulator is assured and in which on the other hand incident leakage current is reduced.

With the foregoing and other objects in view there is provided, in accordance with the invention, an integrated circuit, comprising a first voltage divider generating an actual value from an internal supply voltage, the first voltage divider having a given voltage divider ratio and at least one resistor element with a resistance; a voltage regulator for generating the internal supply voltage, the voltage regulator having one input for applying the actual value and one input for applying a reference voltage as a desired value, the voltage regulator having a sensitivity dependent on the resistance of the at least one resistor element of the first voltage divider; and a second voltage divider connected parallel to the first voltage divider, the second voltage divider having the given voltage divider ratio and at least one switch element for activating and deactivating the second voltage divider.

Since both voltage dividers have the same voltage divider ratio, the result for both the activated and the deactivated second voltage divider is the same value of the output voltage of the voltage regulator to be regulated, because the resultant voltage divider ratio is always constant. However, the resistance in the two cases is different, so that with an unchanged input capacitance of the voltage regulator, different RC constants result, and thus the sensitivity (regulating speed) of the voltage regulator changes. If the second voltage divider is deactivated and only the first voltage divider is operative, then because of the relatively higher resistance, the result is both a lesser sensitivity of the voltage regulator and a reduced leakage current that flows through the voltage divider. Conversely, if the second voltage divider is activated, then the total resistance is due to the parallel circuit of the respective resistor elements and is therefore less in every case than in the previous case described above. Therefore, the sensitivity of the voltage regulator is increased because of the reduced RC constant, yet at the same time the leakage current through the resultant voltage divider increases. It thus becomes advantageously possible to operate the integrated circuit in two different modes, with different sensitivities of the voltage regulator and with leakage currents of different levels, by activating or deactivating the second voltage divider.

In accordance with another feature of the invention, the at least one switch element, which is used for activating or deactivating the second voltage divider, is controlled by an operating mode signal, which makes the at least one switch element conducting in a normal operating mode of the integrated circuit and blocks the switch element in an energy-saving mode.

An energy-saving mode of an integrated circuit is generally understood to be an operating mode in which its current consumption is reduced markedly as compared with a normal operating mode. This is attained, for instance, by providing that only certain basic functions are maintained, while other functions are turned off. Due to the low current consumption in the energy-saving mode, the output voltage of the voltage regulator to be regulated, which is used to supply the integrated circuit or parts thereof, is subjected to a substantially lesser load than in the normal operating mode. Load changes in the energy-saving mode are therefore also extremely slight. For this reason, the voltage regulator need not have the same sensitivity in the energy-saving mode as in the normal operating mode. It is therefore no problem to tolerate higher resistances of the first voltage divider in the energy-saving mode. The effect of these higher resistances is that in the energy-saving mode, the leakage current caused by the voltage regulator is also markedly less than in the normal operating mode. Conversely, in the normal operating mode, due to activation of the second voltage divider, the voltage regulator has the higher sensitivity required for the then-incident greater current loads of the regulated internal supply voltage and the increased load changes. This greater sensitivity is expressed in a higher regulating speed.

In accordance with a further feature of the invention, the advantage to be attained by the invention is all the greater as the difference between the resistances of the first and second voltage dividers becomes greater. The greatest difference in fact occurs at the level of the leakage current flowing at that time through the resultant voltage divider.

In accordance with a concomitant feature of the invention, the voltage regulator is an operational amplifier. However, the invention is also applicable to all other voltage regulators in which the regulating sensitivity depends on a voltage divider ratio.

Other features which are considered as characteristic for the invention are set forth in the appended claims.

Although the invention is illustrated and described herein as embodied in an integrated circuit with a voltage regulator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The figure of the drawing is a schematic circuit diagram of an exemplary embodiment of the invention.

DESCRIPTION OF THE PREFERRED EMBODIMENTS

Referring now in detail to the single figure of the drawing, there is seen an integrated circuit which has a voltage regulator including an operational amplifier OP that is supplied with an external voltage $V_{Ext}$. A reference voltage $V_{REf}$ is supplied as a desired value to a desired value input of the operational amplifier OP. An output of the operational amplifier is connected to a control terminal of a switching transistor T, in the form of a p-channel transistor. A main current path of the switching transistor T connects the external supply voltage $V_{Ext}$ with a first electrode of a buffer capacitor C. The buffer capacitor C has a second electrode connected to ground. An internal supply voltage $V_{Int}$ to be regulated is generated at the first electrode of the capacitor C by switching the switching transistor T.

In order to close the control loop, the internal supply voltage $V_{Int}$ is fed back to an actual value input of the operational amplifier OP. This is done through the use of a first voltage divider, which is disposed between the internal supply voltage $V_{Int}$ and ground, and which includes a third resistor element R3 and a fourth resistor element R4. A circuit node A, which is disposed between the third resistor element R3 and the fourth resistor element R4, is connected to the actual value input of the operational amplifier OP. The circuit shown in the figure also has a second voltage divider, which is connected parallel to the first voltage divider and which has a first resistor element R1 and a second resistor element R2. The second voltage divider has a first switch element S1, in the form a p-channel transistor, between the internal supply voltage $V_{Int}$ and the first resistor element R1. The second voltage divider also has a second switch element S2, in the form of an n-channel transistor, between the second resistor element R2 and ground. A control terminal of the switch element S1 is connected through an inverter I to an operating mode signal EN, and a control terminal of the switch element S2 is connected directly to the operating mode signal EN. It is possible to make the two switch elements S1, S2 simultaneously conducting or to block them simultaneously, through the use of the operating mode signal EN. In this way, the second voltage divider is activated in a normal operating mode of the integrated circuit, or deactivated in an energy-saving mode.

The voltage divider ratio of the first voltage divider R3, R4 agrees with the voltage divider ratio of the second voltage divider R1, R2. In the normal operating mode, in which the second voltage divider R1, R2 is activated, the same voltage divider ratio thus results as in the energy-saving mode, in which only the first voltage divider is operative. Thus, in both cases, the internal supply voltage $V_{Int}$ to be regulated is regulated to the same value. However, the resistances of the resistor elements of the first voltage divider R3, R4 are very much higher than those of the second voltage divider R1, R2. The result in the energy-saving mode is a substantially reduced leakage current through the first voltage divider, as compared with that in the normal operating mode through a resultant voltage divider that is formed by connecting the first and second voltage dividers in parallel.

At the same time, the sensitivity of the voltage regulator in the energy-saving mode is less than in the normal operating mode. This is because the sensitivity and thus the regulating speed of the voltage regulator depend definitively on the RC constant, which is formed by the resistance of the respective voltage divider and the input capacitance of the actual value input of the operational amplifier OP. An input capacitance $C_p$ of the operational amplifier OP is shown in FIG. 1 for the sake of illustration. In the energy-saving mode, the RC constant is formed by a product of the resistance of the parallel circuit of the third resistor element R3 and the fourth resistor element R4 on one hand, and the input capacitance $C_p$ on the other hand. In the normal operating mode, it is formed by a product of the parallel circuit of the resistances of the first, second, third and fourth resistor elements R1, R2, R3, R4 on one hand, and the input capacitance $C_p$ on the other hand.

The resistor elements R1, R2, R3, R4 may, for instance, be formed by field effect transistors. The buffer capacitor C, which serves to buffer the internal supply voltage $V_{Int}$, may, for instance, be formed by input capacitances of circuit units supplied with the internal supply voltage. If they have overly low values, then an additional buffer capacitor may be provided.

We claim:

1. An integrated circuit, comprising:

a first voltage divider generating an actual value from an internal supply voltage, said first voltage divider having a given voltage divider ratio and at least one resistor element with a resistance;

a voltage regulator for generating the internal supply voltage, said voltage regulator having one input for applying the actual value and one input for applying a reference voltage as a desired value, said voltage regulator having a sensitivity dependent on the resistance of said at least one resistor element of said first voltage divider; and a second voltage divider connected parallel to said first voltage divider, said second voltage divider having said given voltage divider ratio and at least one switch element for activating and deactivating said second voltage divider.

2. The circuit according to claim 1, wherein said at least one switch element is controlled by an operating mode signal making said at least one switch element conducting in a normal operating mode of the integrated circuit and blocking said at least one switch element in an energy-saving mode.

3. The circuit according to claim 1, wherein said first voltage divider has a substantially higher impedance than said second voltage divider.

4. The circuit according to claim 1, wherein said voltage regulator includes an operational amplifier, to which the actual value and the desired value are applied.

* * * * *